US005165560A

United States Patent [19]

Ennis, III et al.

[11] Patent Number: 5,165,560

[45] Date of Patent: Nov. 24, 1992

[54] NONROTATING HERMETICALLY SEALED CLOSURE FOR BOTTLE CONTAINING LIQUID

[75] Inventors: James F. Ennis, III, Preston, Conn.; Mark Anderson, Hudson, Wis.

[73] Assignee: Genesis Industries, Inc., Elmwood, Wis.

[21] Appl. No.: 858,347

[22] Filed: Mar. 26, 1992

[51] Int. Cl.[5] ..... B65D 39/00; B65D 43/14; B65D 51/20

[52] U.S. Cl. ..... 215/247; 215/263; 215/274; 215/DIG. 3

[58] Field of Search ..... 215/247, 249, 263, 274, 215/355, DIG. 3

[56] References Cited

U.S. PATENT DOCUMENTS

| | | | |
|---|---|---|---|
| 2,963,189 | 12/1960 | Tourre et al. | 215/274 |
| 3,092,278 | 6/1963 | Järnhall | 215/247 |
| 3,964,627 | 6/1976 | Hennings | 215/247 |
| 3,977,555 | 8/1976 | Larson | 215/247 |
| 4,194,640 | 3/1980 | Crankshaw et al. | 215/249 X |
| 4,366,912 | 1/1983 | Matukura et al. | 215/247 |
| 4,416,661 | 11/1983 | Norman et al. | 215/247 X |
| 4,441,621 | 4/1984 | Matukura et al. | 215/247 |
| 4,456,138 | 6/1984 | Bereziat | 215/232 |
| 4,635,807 | 1/1987 | Knapp | 215/247 |
| 4,967,919 | 11/1990 | Earhart | 215/247 |

*Primary Examiner*—Allan N. Shoap
*Assistant Examiner*—Vanessa Caretto
*Attorney, Agent, or Firm*—Edward H. Loveman

[57] ABSTRACT

A hermetically sealed, nonrotatable closure for a bottle having a cylindrical body containing liquid and having an integral tubular neck formed with a free open end, comprises an annular flange on the tubular neck. A flexible stopper mounts on the flange. A cup shaped cap has a flat top wall with peripherally integral pliable skirt in which is an internal beveled ridge. The ridge engages the flange to lock the cap on the neck of the bottle. The top wall of the cap has a central hole to expose the stopper which can be pierced by a hypodermic needle to extract the liquid from the bottle while the cap remains unbroken on the neck of the bottle. Inside the skirt of the cap are circumferentially spaced teeth which engage in circumferential slots in the annular flange to cooperate with the ridge in preventing axial movement on the cap and stopper on the bottle. Radial webs separate the slots in the annular flange and engage in stalls defined by flat radial walls of the spaced teeth to prevent the cap and stopper from rotating on the tubular neck of the bottle.

10 Claims, 2 Drawing Sheets

NONROTATING HERMETICALLY SEALED CLOSURE FOR BOTTLE CONTAINING LIQUID

BACKGROUND OF THE INVENTION

1. Field of the Invention

This invention relates to the art of bottle caps and closures and more particularly concerns an improved tamper-proof safety closure for a bottle containing liquid and more specifically concerns a hermetically sealed closure which includes a nonrotating cap which is locked in place and cannot be removed without destroying it, but nonetheless permits removal of the liquid contents of the bottle while the cap remains unbroken.

2. Description of the Prior Art

The need has long existed for a secure bottle closure which can be easily applied to a bottle top after the bottle is filled with a liquid, such as a medicine, and which closure cannot be removed without breaking and destroying it, and when in place the closure permits access to the interior of the bottle for removing its liquid contents only by hypodermic needle. Prior secure closures for bottles have the disadvantage that they must be applied by special packing machinery which is not generally available outside a factory. Such closures generally must be destroyed before removing the contents of the bottles, and thus the contents may be modified before removal thereof.

SUMMARY OF THE INVENTION

According to the invention there is provided a secure closure assembly for a bottle containing liquid. The closure assembly includes a flexible, resilient stopper made of natural or artificial rubber, and a cylindrical plastic cap having an internal circumferential ridge. The cap also has internal teeth which engage in circumferential external grooves in an annular flange on the head of the bottle. The head of the bottle also has radial webs separating the grooves which engage in spaces between certain internal teeth in the cap. The cap and stopper can be pressed down on the top of the bottle to engage the ridge under the annular flange on the head of the bottle. The teeth in the cap engage in the grooves in the annular flange, and the webs, separating the grooves, engage in spaces between the teeth in the cap. Thus the cap locks itself securely and nonrotatably in place and cannot be removed without breaking or destroying the cap. Furthermore the closure proves a hermetic seal so that liquid cannot leak out of the bottle at any time. The top of the cap has a central hole where the stopper is exposed for penetration by a hypodermic needle. The closure remains securely locked in place at all times so that the bottle can be safely suspended in an inverted or upside down position if desired. The bottle and closure can be made of any suitable materials, but recyclable or biodegradable plastics are preferred since they are light in weight, flexible, strong, dimensionally and chemically stable, and inexpensive.

These and other objects and many of the attendant advantages of this invention will be readily appreciated as the same becomes better understood by reference to the following detailed description when considered in connection with the accompanying drawings in which:

DESCRIPTION OF THE PREFERRED EMBODIMENTS

Figure 2:
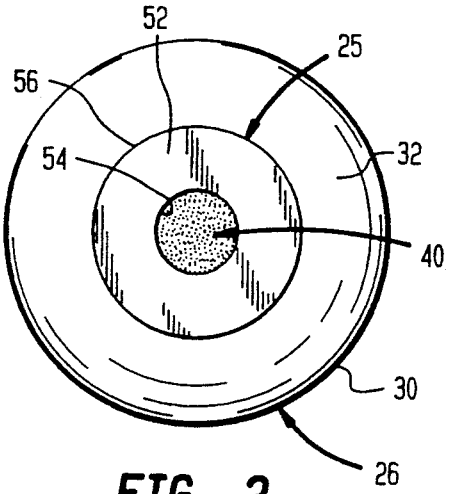
FIG. 2 is a top plan view taken along line 2—2 of FIG. 1.
Figure 1:
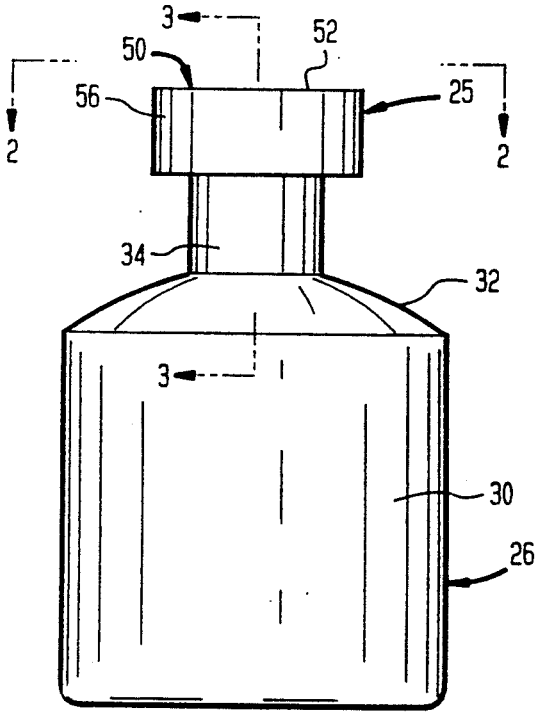
FIG. 1 is a side elevational view of a bottle with safety closure assembly embodying the invention.
Figure 3:
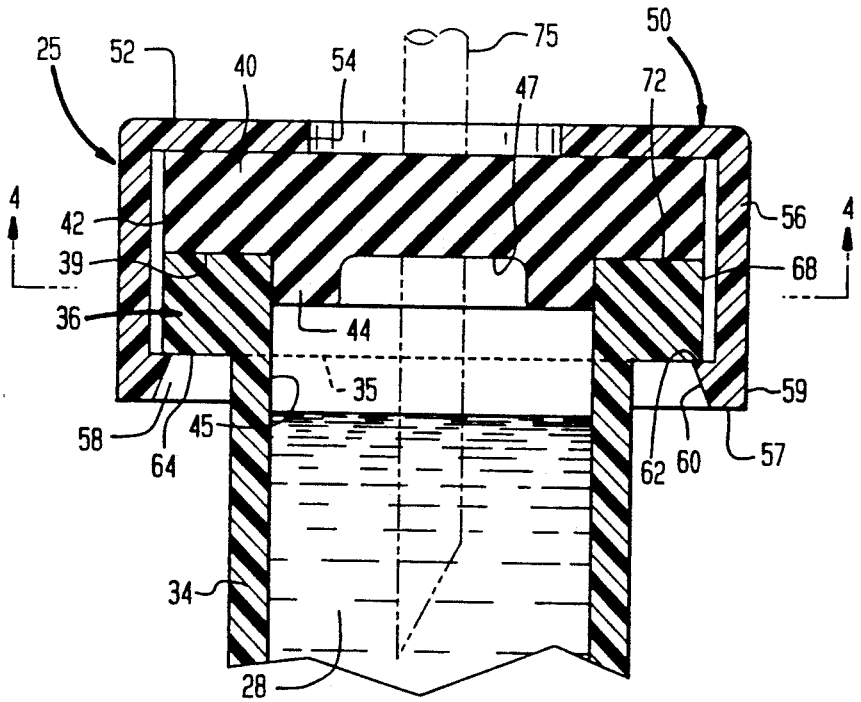
FIG. 3 is a enlarged fragmentary axial sectional view taken along line 3—3 of FIG. 1.

Referring now to the drawings wherein like reference characters designate like or corresponding parts throughout there is illustrated in FIGS. 1-5 a closure assembly generally designated as reference numeral 25 for a bottle 26 containing a liquid 28. The bottle 26 has a cylindrical body 30 with an externally convex annular shoulder 32 and integral axial tubular neck 34 terminating in a circular annular flange 36 at an open end 35. The flange 36 has a flat top 39. A flexible rubber stopper 40 is mounted at the top of the flange 36. The stopper 40 has a flat annular plate 42 equal in diameter to that of the flange 36, and a tapered axial plug 44 which fits snugly into a passage 45 defined by the neck 34. The stopper 40 has an inner concavity 47. Covering the stopper 40 and the top of the bottle 26 is a cap 50 which has a flat circular top wall 52 formed with a central hole 54. A cylindrical skirt or wall 56 is integral with the periphery of the top wall 52. The inner bottom end of the cylindrical wall or skirt 56 is formed with a straight section 59 and a beveled ridge or rib 58. The inner side 60 of the ridge 58 is beveled radially inwardly to define an annular shoulder 62. The diameter of the straight section 59 is 0.010" less than the external diameter of the flange 36 and extends longitudinally from the edge of the skirt 56 for approximately 0.050". The ridge 58 is engaged all around its periphery to an underside 64 of the flange 36.

Figure 4:
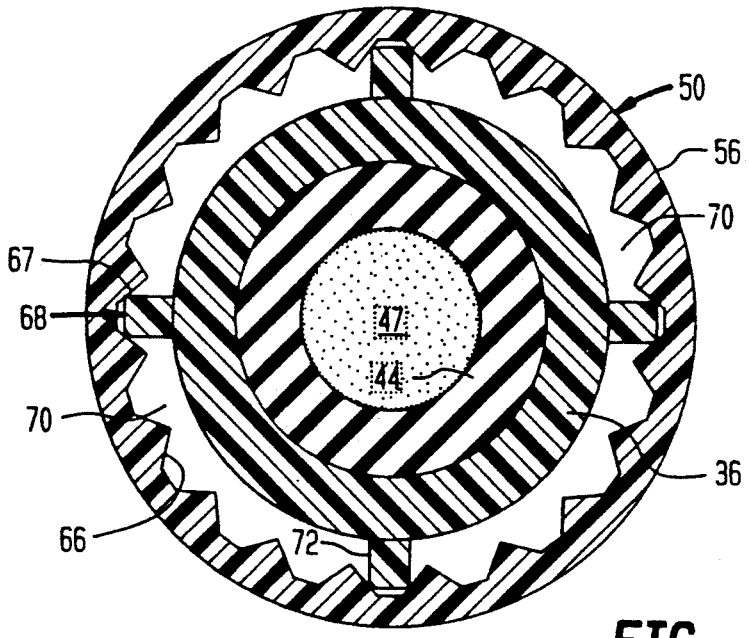
FIG. 4 is an enlarged cross sectional view taken along line 4—4 of FIG. 3.
Figure 5:
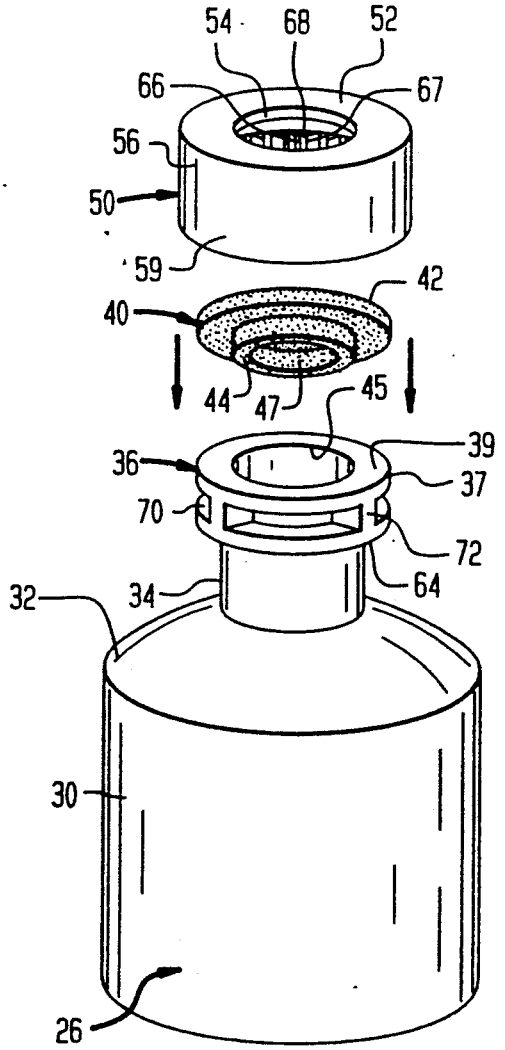
FIG. 5 is an exploded perspective view on an enlarged scale of parts of the closure assembly including cap, stopper and bottle top.

The cap wall 56 is further formed with an internal circumferential array of spaced radially extending angular teeth 66; see FIG. 4. Between juxtaposed teeth 66 are a pair of flat radial walls 67 defining therein between a space or stall 68. The teeth 66 engage in external circumferential extending grooves 70 formed in the annular flange 36 of the top of the bottle 26 to lock the cap 50 and the stopper 40 against axial movement on the bottle 26. The grooves 70 have four spaced radially extending webs 72 which engage in spaces 68 in the cap 50 to lock the cap 50 and the stopper 40 against rotation on the top of the bottle 50. When the cap is pressed down on the flexible top of the bottle 26 with the rubber stopper 40 therebetween, the cap 50 and the stopper 40 are locked in place on top of the bottle 26 and cannot be turned or removed without breaking the cap 50. The bottle 26 is hermetically sealed by the closure and the liquid contents cannot leak out. The contents of the bottle 26 can be removed by inserting a hypodermic needle 75 through the hole 54 in the top 52 and through the stopper 40 as indicated by dotted lines in FIG. 3. If desired the bottle 26 can be inverted and the needle 75 can be inserted upwardly into the neck 34 thereof.

The cap 50 is preferably made of a slightly flexible material such as polyethylene or other plastic. The bottle 26 can be made of the same or similar material. To mount the cap 50 on the bottle 26, the plug 44 of the resilient flexible stopper 40 will be inserted into the passage 45 of the neck 34; see FIGS. 3–5. Then the cap 50 will be placed over the stopper 40 with the periphery 37 of the flange 36 in contact with the flat end 57 of the cap 50. By pressing the bottle 26 and the cap 50 together, the skirt 56 will move outwardly and the end 57 will move downwardly toward the neck 34 of the bottle 26 with the ridge 58 forced over the flange 36 so that the shoulder 62 of the ridge 58 will engage in tension under the flange 36.

At the same time, the teeth 66 of the cap 50 will engage in the grooves 70 of the annular flange 36, while the webs or ribs 72 will engage in the spaces or stalls 68 between the teeth 66. The teeth 66 cooperate with the ridge 58 to prevent axial movement of the cap 50 and the stopper 40 on the bottle 26. The webs 72 will prevent rotation of the cap 50 and the stopper 40 on the bottle 20. This locks the cap 50 in place, and secures the stopper 40 in sealing position on the top 39 of the bottle 26. The cap 50 and stopper 40 cannot accidentally come loose and cannot be pried off or shaken loose, without fracturing the cap 50.

After the bottle 26 is empty it may be discarded with cap 50 still in place.

The cap 50 and the stopper 40 can be applied to close the bottle 26 manually, or by mass production machinery at very high speed. The cap 50 and the stopper 40 as well as the bottle 26 are made of inexpensive materials so they can be supplied at low cost.

Although not illustrated, a plastic cover having a shape of a flat disc with an outside diameter slightly smaller than the hole 54 may be manufactured integral with the cap 50 and secured over the central hole 54 to the cap 50 via a plurality of spaced webs. In this configuration the contents of the bottle 26 may be removed by first removing the plastic cover, i.e. inserting a syringe needle, knife or other tool between the webs to pry upwardly on the plastic cover to break the webs and thereby separate the plastic cover from the cap 50, whereby the central hole 54 will be clear to permit insertion of the syringe needle through the rubber stopper 40 for removing the liquid contents from the bottle 26.

It should be understood that the foregoing relates to only a preferred embodiment of the invention which has been by way of example only, and that it is intended to cover all changes and modifications of the example of the invention herein chosen for the purposes of the disclosure, which do not constitute departures from the spirit and scope of the invention.

What is claimed:

1. A hermetically sealed closure for a bottle having a cylindrical body containing a liquid and having an integral tubular neck formed with a free open end, and an annular flange having a flat top surrounding and integral with said open end of said neck, said flange having a cylindrical side wall, said closure comprising:

a flexible flat stopper on said flange;

a cup shaped cap on said stopper and flange, said cap having a flat circular top wall peripherally integral with a pliable cylindrical skirt, said skirt having an outside diameter larger than said flange and an open bottom end section with an inside diameter slightly less than that of said cylindrical side wall of said flange, and having an internal beveled annular ridge extending from said bottom end section and tapering inwardly from said open bottom end section toward said top wall of said cap; and mutually engaging means on said skirt of said cap and said side wall of said flange for preventing rotation of said cap; whereby said cap locks on said stopper and said flange with said ridge engaged under said flange when said (neck) flange is inserted into said open end of said skirt and said cap is forced down on said flange and said mutually engaged means on said cap and said flange cooperate with said ridge to prevent said cap and stopper from respective rotation and axial movement on said bottle.

2. A hermetically sealed closure as claimed in claim 1 wherein said mutually engaging means comprises a circumferential array of teeth inside said skirt of said cap, and a plurality of circumferential slots in said cylindrical side wall of said flange, said slots receiving a plurality of said teeth when said cap is forced down on said flange to lock said cap and stopper in place in cooperation with said ridge when said ridge is engaged under said flange.

3. A hermetically sealed closure as claimed in claim 2, wherein said teeth are formed with radial walls juxtaposed between each pair of said teeth and further comprising other means on said cap and said flange preventing rotation of said cap and said stopper on said neck of said bottle, said other means comprising radial webs spacing apart said circumferential slots in said cylindrical side wall of said flange, said spaced radial walls on said teeth defining stalls which receive said webs to prevent said cap and stopper from rotating on said bottle.

4. A closure as claimed in claim 3, wherein said stopper has a flat plate abutting said top of said flange and covering said open end of said bottle to seal the same.

5. A closure as claimed in claim 4, wherein said stopper has a central plug with said flat plate whereby said plug is inserted into said bottle to seal the same.

6. A closure as claimed in claim 4, wherein said stopper has a central plug integral with said plate and inserted into said neck to seal the same, whereby a hypodermic needle must be inserted through said hole, said plate, and said plug to extract said liquid from said bottle while said cap remains in unbroken condition on said bottle.

7. A closure as claimed in claim 5, wherein said top wall of said cap has a central hole exposing said plate, so that a hypodermic needle can be inserted through said hole and said stopper, axially of said neck to extract said liquid from said bottle while said cap remains in unbroken condition on said bottle.

8. A closure for a bottle having an integral tubular neck with an open end and an annular flange having a cylindrical side wall and a flat top surrounding and integral with said open end of said neck, comprising:

a cup shaped cap on said annular flange, said cap having a flat circular top wall peripherally integral with a pliable cylindrical skirt and an open bottom end, said cap having an internal beveled annular ridge extending from said bottom end section and tapering inwardly toward said top wall of said cap, so that said cap can lock on said flange with said ridge engaging under said flange when said flange is inserted into said open end of said skirt and said cap is forced down on said flange; and mutually engageable means on said skirt of said cap and said side wall of said flange cooperating with said ridge to prevent said cap from respective rotational and axial movement on said bottle.

9. A closure as claimed in claim 8, wherein said mutually engageable means comprises a circumferential array of teeth inside said skirt of said cap, and a plurality of circumferential slots in a cylindrical side wall of said flange, said slots receiving a plurality of said teeth when said cap is forced down on said flange to lock said cap in place in cooperation with said ridge when said ridge is engaged under said flange.

10. A closure as claimed in claim 9, wherein said teeth are formed with radial walls juxtaposed between each pair of said teeth and further comprising other means on said cap and said flange for preventing rotation of said cap on said bottle, said other means comprising radial webs spacing apart said circumferential slots in said cylindrical side wall of said flange, said spaced radial walls on some of said teeth in said skirt defining stalls which receive said webs to prevent said cap from rotating on said bottle.

* * * * *